US006149209A

United States Patent [19]

Barton

[11] Patent Number: 6,149,209

[45] Date of Patent: Nov. 21, 2000

[54] HANGING CLOSURE LATCH

[76] Inventor: Donn Barton, 217 Hollister Way North, Glastonbury, Conn. 06033

[21] Appl. No.: 09/244,720

[22] Filed: Feb. 4, 1999

[51] Int. Cl.[7] ..... E05C 5/00

[52] U.S. Cl. ..... 292/67; 292/189; 292/207; 292/238; 292/338

[58] Field of Search ..... 292/67, 238, 210, 292/207, 203, 290, 298, 108, 230, 231, 180, 189, 338, DIG. 65, DIG. 71

[56] References Cited

U.S. PATENT DOCUMENTS

| | | | |
|---|---|---|---|
| 966,865 | 8/1910 | Schuyler | 292/207 |
| 994,789 | 6/1911 | Repass | 292/67 |
| 1,035,005 | 8/1912 | Harris | 292/67 |
| 1,166,791 | 1/1916 | Scroggins | 292/290 |
| 1,210,826 | 1/1917 | Minor | 292/210 |
| 1,491,538 | 3/1921 | King . | |
| 1,542,486 | 6/1925 | Mueller | 292/67 |
| 1,546,175 | 7/1925 | Lyons | 292/67 |
| 2,467,032 | 4/1941 | Hill . | |
| 2,532,586 | 12/1950 | Wickwire | 292/290 |
| 3,146,502 | 9/1964 | Reiss, Sr. et al. | 292/67 |
| 4,699,413 | 10/1987 | Mueller | 292/67 |
| 5,114,194 | 5/1992 | Toifl et al. | 292/106 |
| 5,452,929 | 9/1995 | Anderson | 292/288 |
| 5,704,662 | 1/1998 | Kwiatkowski | 292/194 |

*Primary Examiner*—B. Dayoan
*Assistant Examiner*—Clifford B Vaterlaus
*Attorney, Agent, or Firm*—McCormick, Paulding & Huber LLP

[57] ABSTRACT

A latch that secures a closure member includes a bolt and a support member, with the support member attaching the bolt to a part, which could be a door frame. The support member is configured with head and shank portions, so that when the support member is tightened to the part, the bolt is free to rotate and slide about the shank. The bolt is held captive on the support member by a shoulder of the head, and a longitudinal slot in the bolt allows the bolt to rotate and slide about the shank. The bolt has a second slot with parallel sides that engage parallel flat surfaces of the support member head, thereby suspending the bolt in a horizontal closure locking position to allow unobstructed opening or closing of the closure member.

3 Claims, 4 Drawing Sheets

HANGING CLOSURE LATCH

BACKGROUND OF INVENTION

1. Field of the Invention

This invention relates to a closure fastening device and, more particularly, to a latch that prevents unwanted opening of the closure it fastens.

2. Background Art

Latching systems are used every day to secure many different types of closures, including doors, windows, cabinets, and closets. Latches vary in complexity of operation and the ease with which they are installed. Certain types of latches utilize intricate components and premium materials for use with fine furniture, while others are designed to withstand daily use in an outdoor environment. Similarly, the nature of the closure to which the latch is applied often determines which type of closure will be used. If the latch is being installed on a shed or outdoor storage container, the latch should be simple to use, inexpensive, and durable enough to endure everyday use in harsh weather. There are many types of latches designed for such an application, yet all have failed to offer single-handed operability, simple construction and easy installation, while having the capability to maintain closure in a vibration-prone environment such as the outdoors.

One attempted solution is the mechanism disclosed in U.S. Pat. No. 1,546,175. A door is kept shut by this device which includes a pivot plate rotating about stud, and several brackets attached to the door and door frame to retain the pivot plate in the locked position. This assembly is not easily operated with a single hand and it only remains locked using a separate locking device such as a padlock.

Another attempted solution is found in U.S. Pat. No. 1,542,468. This device includes a moveable bolt mounted to a bolt support, which assembly is then fastened to a door frame. To operate the device, the bolt is either rotated upwardly relative to its support to clear the door, or moved into the path of the door to prevent the door from opening. The assembly is bulky, which may present problems in intricate applications, as may the complexity with which the device is fastened to a door frame. For instance, if there is inadequate spacing between the door and its frame, the frame may require modification to properly fit the device, which wraps around the door frame.

There is still a need for a latch that will not release by itself, or require a complicated, potentially costly, and time consuming installation.

SUMMARY OF THE INVENTION

It is an object of the present invention to provide a latch for a closure that will remain dosed in rigorous environments such as the outdoors.

It is a further object of the present invention to provide a latch for a closure that can be operated single-handedly.

It is yet a further object of the invention to provide a latch for a closure that can be easily and quickly installed with minimal damage to the closure frame or surroundings.

DISCLOSURE OF THE INVENTION

According to the present invention, a bolt received on a stud portion is fastened to an associated support member and hangs in latching position over the closure by the force of gravity, preventing unwanted opening of the closure. The bolt has a longitudinal slot through which the stud portion is received, allowing the bolt to slide relative to the stud along the length of the longitudinal slot. The stud portion and the slot are also provided with a cooperating means to hold the bolt in a horizontal attitude and out of interference with the closure when the stud portion is located in one portion of the bolt slot, so that the closure may be opened and dosed freely, and when the stud portion is in another portion of the bolt slot, where the bolt is free to rotate in the slot portion to allow the bolt to fall by gravity to its vertical closure locking condition or to be moved by hand from that condition to its horizontal closure unlocking condition.

In further accordance with the invention the support member has a head located at one of its ends, to prevent the bolt from moving off of the stud portion of that end, and at the other end of the stud portion has an attaching portion extending in the longitudinal direction of the stud portion received in the frame surrounding the closure for attaching the support member to the frame, and when the support member is so attached, the frame itself prevents the both from moving off of the stud portion of the other end.

These and other objects, features and advantages of the present invention will become more apparent in the light of the following detailed description of best mode embodiments thereof as illustrated in the accompanying drawings.

BEST MODE FOR CARRYING OUT THE INVENTION

Figure 1:
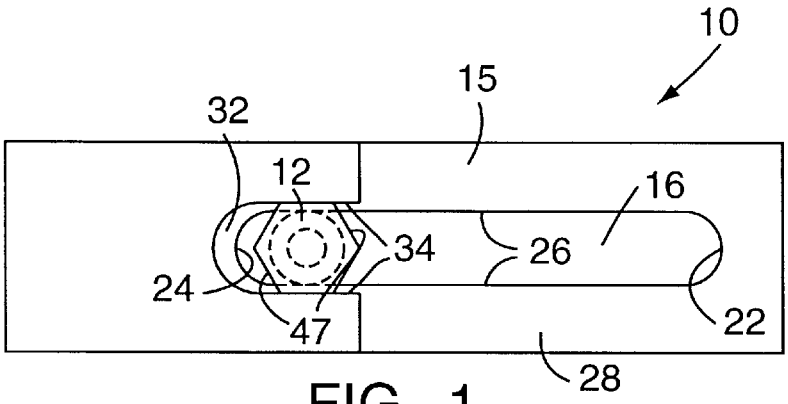
FIG. 1 is a front view of the latch embodying the invention, with the bolt being shown in the open position to allow opening of the closure.
Figure 2:
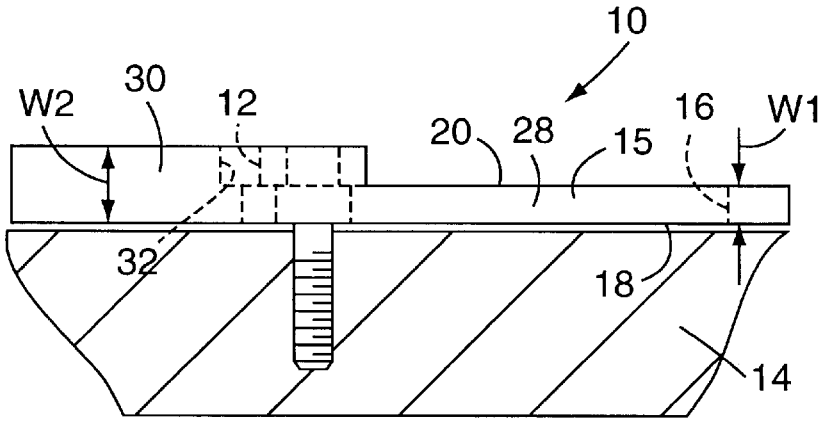
FIG. 2 is a partly elevational and partly cross-sectional view of the latch in FIG. 1.

Referring to FIGS. 1 and 2, a latch 10 for holding closed a door, window, or other closure member includes a support member 12 adapted to be mounted to a part 14, such as a door frame, and a bolt 15 loosely received in the support member 12.

In the embodiment shown, the bolt 15 is generally rectangular, but it can take various shapes and remain functional. The bolt 15 has an elongated slot 16 passing through the bolt 15 from a rear side 18 to a front side 20 and extending longitudinally along the bolt 15 from a first slot end 22 to a second slot end 24. The slot 16 is formed by two parallel side surfaces 26.

The bolt 15 also has a thickness measured by the separation of said front side 20 and said rear side 18 of the bolt 15, with a first longitudinal portion 28 having a thickness W1 less than a thickness W2 of a second longitudinal portion 30. In the embodiment shown in FIG. 1, the second longitudinal portion 30 has a rotation holding slot 32 with parallel engagement surfaces 34 spaced further apart than the parallel side surfaces 26 of the elongated slot 16. The parallel side surfaces 26 of the elongated slot 16 extend into the second longitudinal portion 30 for a length at least equal to, but preferably longer than, length L2 shown in FIG. 3.

Figure 3:
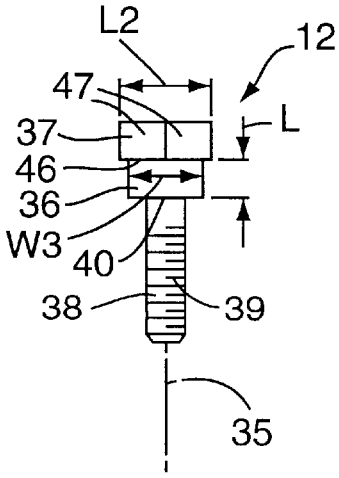
FIG. 3 is a side view of the stud of FIG. 1, showing the head, shank and attachment portions.

Referring to FIG. 3, the support member 12 has three sections aligned along a longitudinal axis 35, including a shank portion 36 located between a head 37 and an attachment portion 38. The attachment portion 38 extends along longitudinal axis 35 to a first shoulder 40 of a shank portion 36, and includes threads 39 for attaching the latch 10 to the part 14 of FIG. 2.

The shank portion 36 of support member 12 has a diameter W3 slightly less than the separation of parallel side surfaces 26 shown in FIG. 1, to allow the bolt 15 to move freely about the support member 12, and particularly, about the shank portion 36. The shank portion 36 has a longitudinal length L which is slightly larger than the width W1 of the first longitudinal portion 28 of the bolt 15 of FIG. 1. The shank portion extends along the longitudinal axis 35 from the first shoulder 40 to a second shoulder 46.

Figure 6:
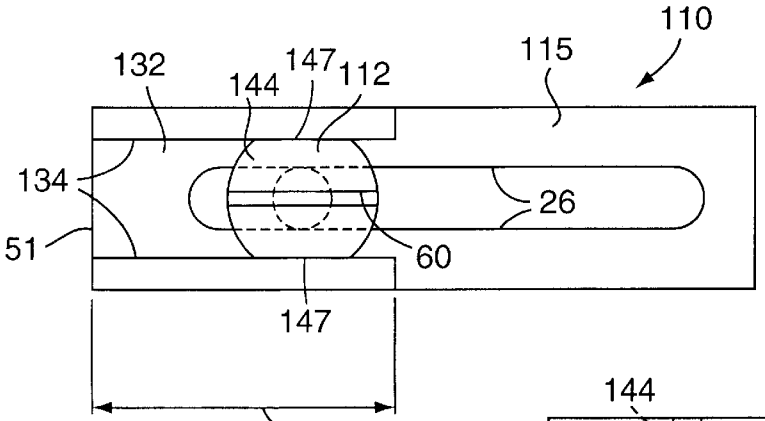
FIG. 6 is a front view of an alternate embodiment of the latch, showing the bolt configured to cooperate with a head of a screw that includes parallel flats.
Figure 10:
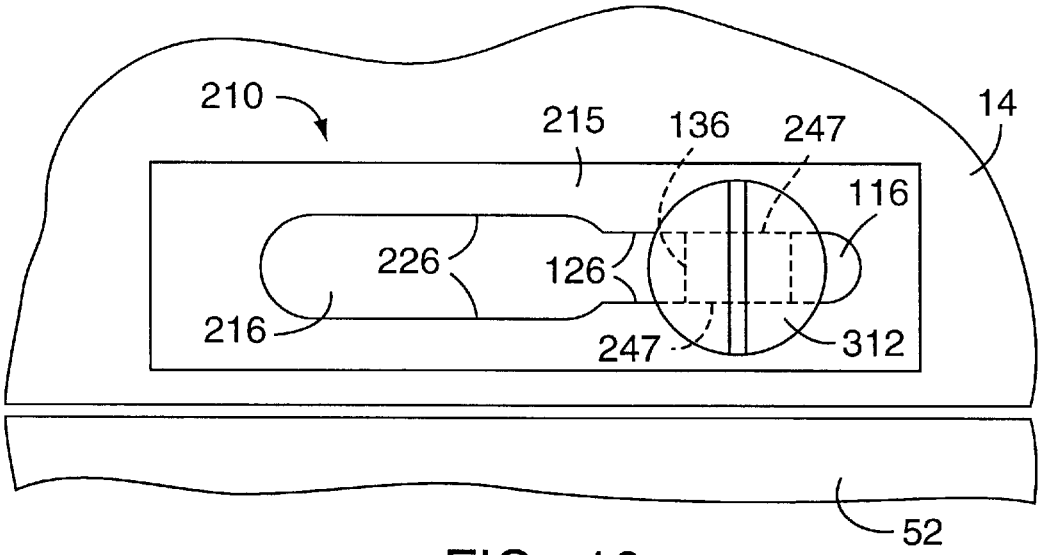
FIG. 10 is a broken away front view of an alternate embodiment of the latch, showing the bolt in its closure unlocking position.
Figure 11:
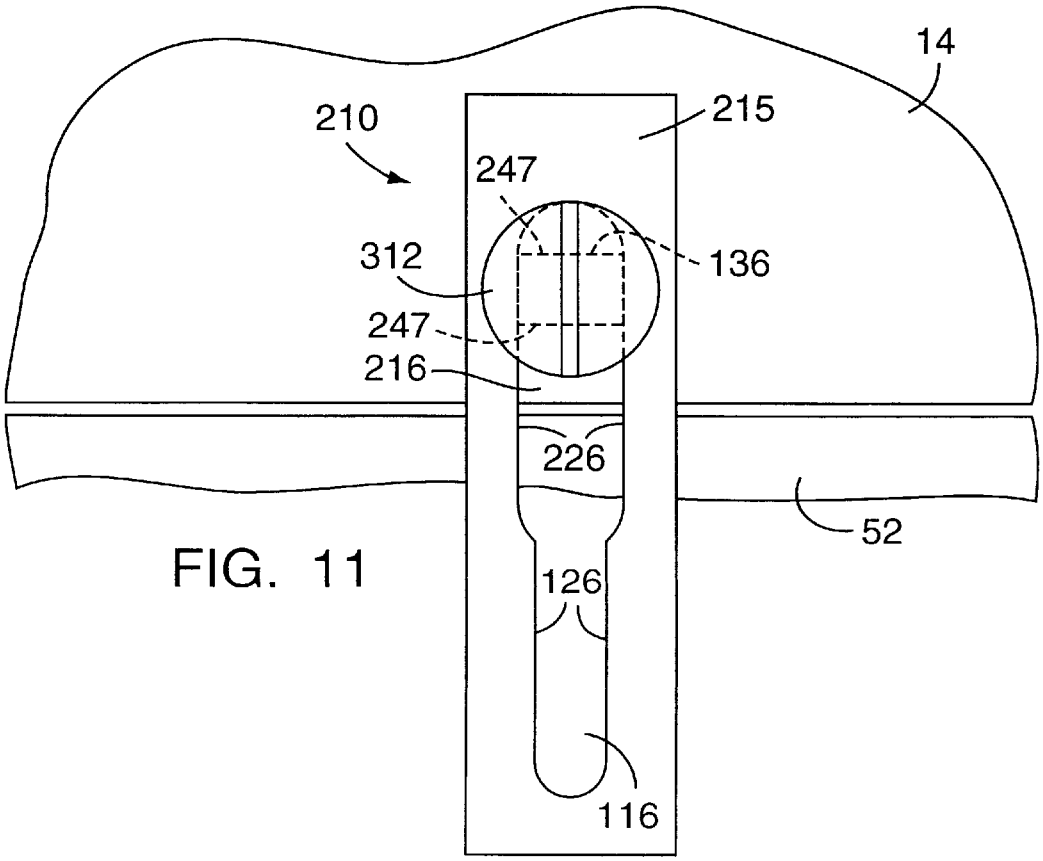
FIG. 11 is a front view of the latch shown in FIG. 10 with the bolt shown in its closure locking position.

A head 37 of support member 12 extends longitudinally from the second shoulder 46 to the end of support member 12. The head 37 can have one of several configurations to function with different types of hand tools used for installation. A hexagonally shaped head with parallel head surfaces 47 is shown in FIGS. 1–3 for use with a standard socket wrench or open-ended wrench. As seen in FIGS. 6, 10 and 11, the head 144 can also resemble that of a conventional screw, with a slot 60 for use with a screwdriver. The head 144 of screw 112 in FIG. 6 has been modified with two head flats 147 for engagement with parallel walls 134 of the engagement slot 132.

Figure 4:
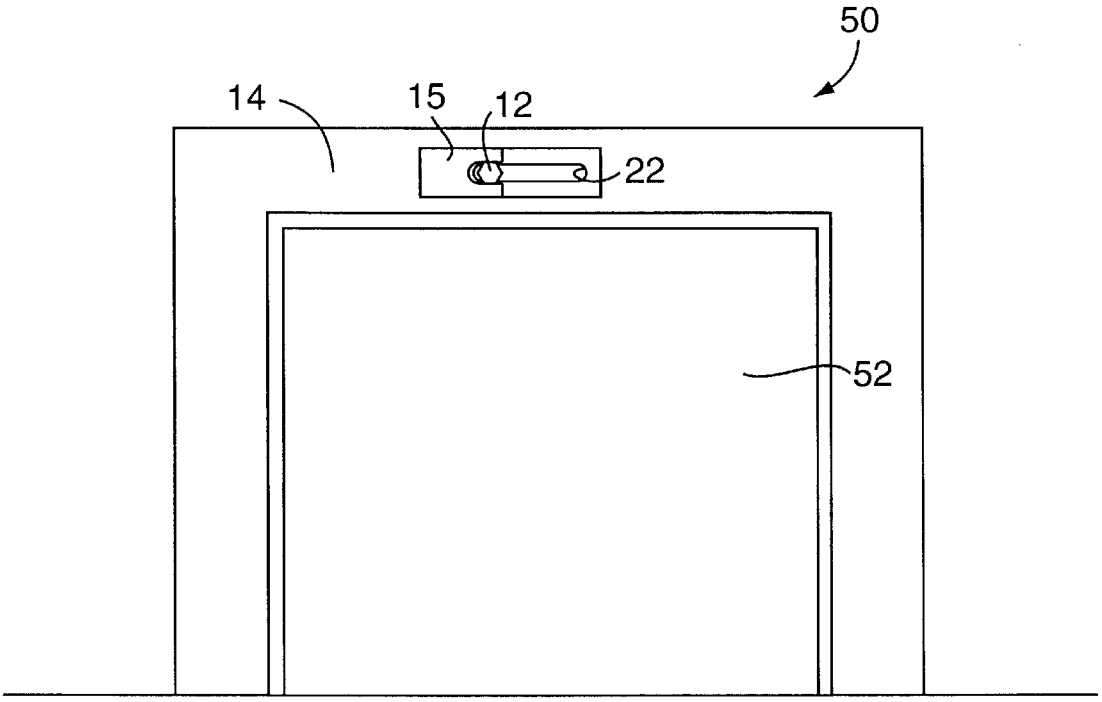
FIG. 4 is a front view of the FIG. 1 latch installed on a door frame and oriented in the closure unlocking position to allow opening of the closure.
Figure 5:
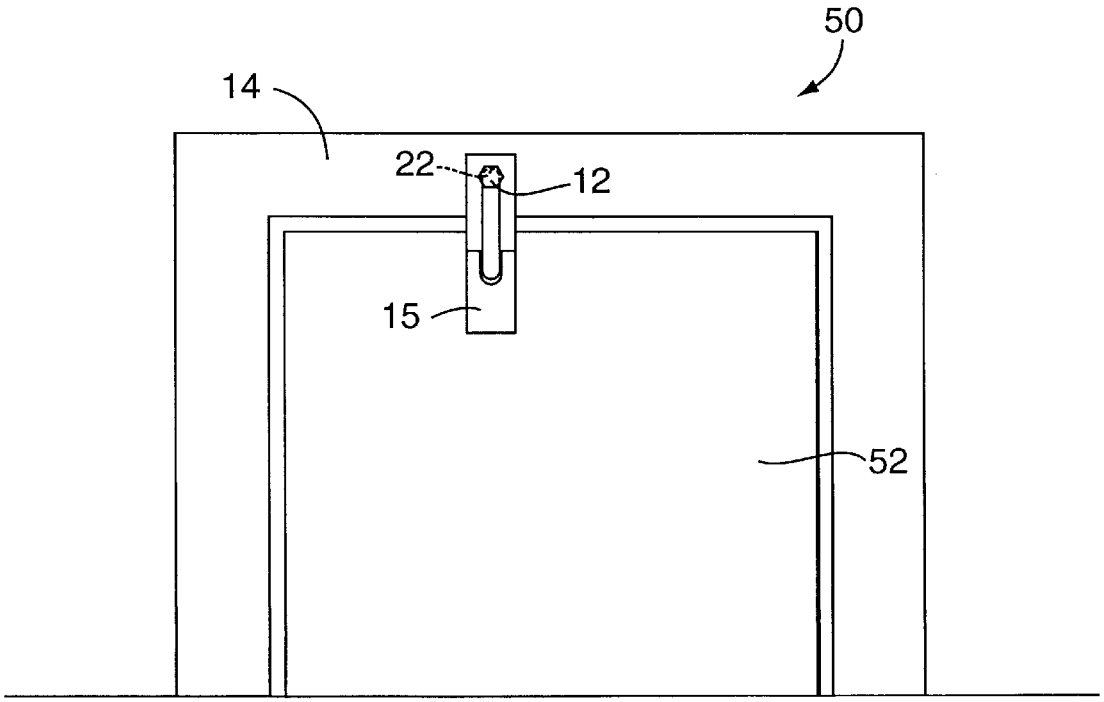
FIG. 5 is a view similar to that of FIG. 4 but with the bolt being shown in the closure locking position.

Now referring to FIGS. 4 and 5, a closure assembly 50 includes a support member 12 attaching the bolt 15 to part 14. The bolt 15 is in a closure unlocking position when the bolt 15 is engaged horizontally on the support member 12, as seen in FIG. 4. The bolt 15 is in a closure locking position when the bolt 15 is hanging vertically from the support member 12 at the first slot end 22 of the bolt 15, as shown in FIG. 5. In this position, the bolt 15 rests in the path of the closure member 52. To open the closure member 52, the bolt 15 is first rotated in a clockwise or counter-clockwise direction about the support member 12 until the bolt 15 is oriented in a horizontal position. In this position, two parallel head surfaces 47 of the head 37 are parallel with the parallel engagement surfaces 34 forming the rotation holding slot 32 of bolt 15 (best seen in FIG. 1). The bolt 15 is then engaged with the support member 12 by sliding the bolt 15 in a direction that brings the support member 12 into engagement with the rotation holding slot 32. In this position, the bolt 15 can remain horizontally stable while the closure member 52 is opened or closed freely.

Once the closure member 52 is returned to the closed position, the bolt 15 can be moved horizontally to free the support member 12 from the rotation holding slot 32, and the bolt 15 can then rotate about the support member 12 to the original vertically hanging, closed position.

Figure 7:
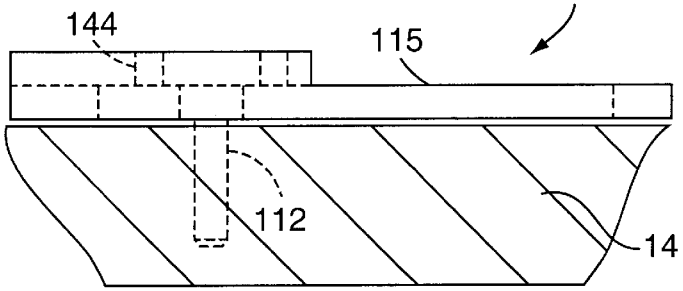
FIG. 7 is a top view of the latch of FIG. 6.

Referring to FIGS. 6 and 7, the latch 110 includes the bolt 115 fastened to associated member 14 by screw 112. The bolt 115 has parallel engagement surfaces 134 that are spaced further apart than the parallel side surfaces 26 and extend longitudinally a length L3 from a second end 51. The screw 112 is equipped with a slot 60 used for attaching the screw 112 to the part 14 using a screwdriver or the like. The head 144 has parallel head surfaces 147 to engage with the parallel engagement surfaces 134 when the bolt 115 is in the closure locking position.

Figure 8:
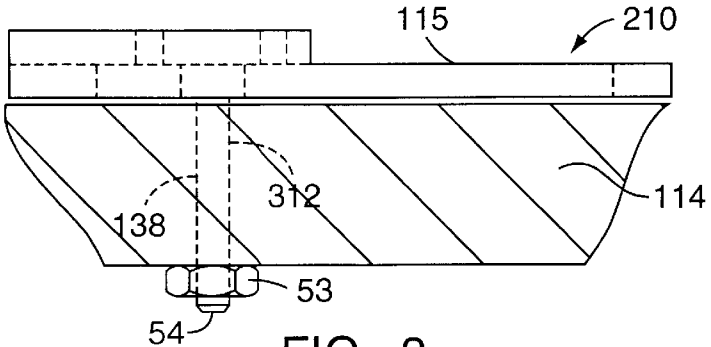
FIG. 8 is a view similar to that of FIG. 7 but showing an alternate embodiment of the stud.

Referring to FIG. 8, the latch 210 includes the bolt 115 fastened to associated member 114 with screw 312 and nut 53. An attachment portion 138 slides freely through the part 114 to engage a nut 53 at a free end 54 of attachment portion 138, securing the latch 210 to the part 114.

Figure 9:
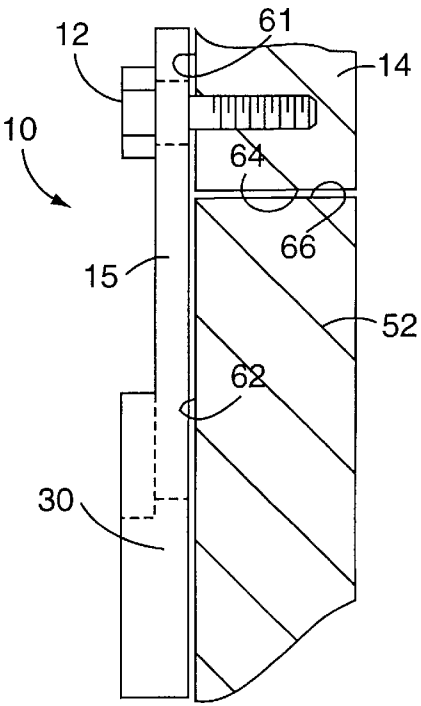
FIG. 9 is a partially broken away side view of the latch of FIG. 1 shown in its closure locking position.

Referring to FIG. 9, the latch 10 is shown in the closure locking position which prevents opening of the closure member 52. In the closure locking position, the front face 61 of part 14 and front surface 62 of closure member 52 are substantially parallel. The support member 12 is attached to part 14 such that when bolt 15 is hanging vertically from the support member 12, the second longitudinal portion 30 of bolt 15 extends downwardly beyond a lower edge 64 of part 14 and a top edge 66 of closure member 52.

Referring to FIGS. 10 and 11, the latch 210 includes the bolt 215 attached to part 14. The bolt 215 has an elongated slot with a first slot section 116 having side surfaces 126 spaced closer together than the side surfaces 226 of a second slot section 216.

The shank portion 136 of stud 312 is configured with two parallel flats 247 spaced slightly closer together than the side surfaces 126 of the first slot section 116. This allows the bolt 215 to be positioned so that the first slot section 116 engages the parallel flats 247 of the stud 312, holding the bolt 215 in a horizontal orientation.

In operation, latch 10 is assembled by inserting the support member 12 through the bolt 15 and tightening the support member to the part 14, which can be a door frame or other closure. The length L of the shank 36 is slightly larger than the width W1 of the bolt 15 so that, when the support member 12 is tightened, the first shoulder 40 engages the adjacent surface of the part 14. Furthermore, the tightening sequence of the support member 12 is carried out so that two of the parallel flat surfaces 47 of head 37 are left in a horizontal position to engage with the parallel engagement surfaces 34 of bolt 15.

In FIGS. 10 and 11, latch 210 is installed by fastening support member 312 through bolt 215 and into part 14. Support member 312 is tightened so that parallel flats 247 are left horizontally, and bolt 215 can be engaged and suspended in a horizontal attitude from support member 312. The closure member 52 is free to open when the bolt 215 is engaged horizontally. The latch 210 is in the closure locking position with the bolt 215 hanging vertically from the second slot section 216, thereby preventing opening of closure member 52.

In all latch configurations, whether support member 12 or 112 is used with bolt 15, bolt 115, or bolt 215, the bolt engages the support member when the bolt is in a horizontal orientation. This is ensured using a tightening sequence of the support member 12 to the part 14, such that the parallel head surfaces 47 of the head 37 are left in a horizontal orientation. In this manner, if a screw 112 is used, as shown in FIG. 6, the screw 112 is tightened so that the parallel head surfaces 147 are left in a horizontal orientation. If a screw 312 is used, such as shown in FIG. 10, it is tightened so parallel head surfaces 247 are left in a horizontal orientation-This procedure ensures the flat features of the support member will remain in a horizontal orientation for proper engagement with the bolt, as shown in FIG. 5.

One advantage of the present invention is that the latch can be operated single-handedly. The operator places the bolt into the horizontally engaged position to open the window or door, and return the bolt to the vertically hanging locked position after the closure is returned to the dosed position.

Another advantage of the present invention is that the latch can be installed easily and quickly to a door, closet, window, or other closure frame.

While preferred embodiments have been shown and described above, various modifications and substitutions may be made without departing from the spirit and scope of the invention. Accordingly, it is to be understood that the present invention has been described by way of example and not by way of limitation.

What is claimed is:

1. A latch for releasably holding closed a door, drawer, window or other closure member having a vertical front surface ending at a top edge and which closure member is movable horizontally relative to an associated member located above and adjacent to the closure member, and having a vertical front face ending at a lower edge, the closure member being movable between a closed position, at which said front surface and said front face are located in substantially the same plane, and an open position at which said front surface and said front face are located in substantially different planes, said latch comprising:

a bolt;

a support member with a longitudinal axis;

said bolt being of an elongated shape with first and second longitudinal ends and front and rear faces oriented in opposite directions;

said bolt having an elongated slot defined at least in part by substantially parallel opposed side surfaces extending through said bolt from said front face to said rear face, said slot terminating at first and second slot ends short of said first and second bolt ends, respectively;

said support member having a shank portion receivable in said elongated bolt slot and having front and rear ends spaced apart from one another along said longitudinal axis;

said support member also having an attachment portion extending along said longitudinal axis from said rear end of said shank portion and which attachment portion is receivable in said associated member to attach and hold said support member to said associated member with said bolt received on said shank portion;

said support member also having a head portion adjacent said front end of said shank portion and engageable with said bolt to hold said bolt on said support member, said head portion having at least one planar surface parallel to said longitudinal axis;

said bolt being further defined by first and second bolt sections, said front and rear faces being spaced further apart in said second bolt section than in said first bolt section, said second bolt section defining an engagement slot approximately coaxial with said elongated slot, and defined in part by substantially parallel opposed side surfaces spaced farther apart than said side surfaces of said elongated slot, at least one of said engagement slot side surfaces being engagable with said planar surface of said head portion when said support member is located in said second bolt section to prevent rotation of said bolt relative to said support member and allow free movement of said closure member between said closed and open positions; and said bolt and support member being further configured that when said head portion is located in said first bolt section, said bolt is free to rotate relative to said elongated slot about said longitudinal axis and due to its weight to assume a vertically oriented position.

2. A latch for releasably holding closed a door, drawer, window or other closure member having a vertical front surface ending at a top edge and which closure member is movable horizontally relative to an associated member located above and adjacent to the closure member, and having a vertical front face ending at a lower edge, the closure member being movable between a closed position, at which said front surface and said front face are located in substantially the same plane, and an open position at which said front surface and said front face are located in substantially different planes, said latch comprising:

a bolt;

a support member with a longitudinal axis;

said bolt being of an elongated shape with first and second longitudinal ends and front and rear faces oriented in opposite directions;

said bolt having an elongated slot defined at least in part by substantially parallel side surfaces extending through said bolt from said front face to said rear face, said slot terminating at first and second slot ends short of said first and second bolt ends, respectively;

said support member having a shank portion receivable in said bolt slot and having front and rear ends spaced apart from one another along said longitudinal axis;

said support member also having an attachment portion extending along said longitudinal axis from said rear end of said shank portion and which attachment portion is receivable in said associated member to attach and hold said support member to said associated member with said bolt received on said shank portion;

said support member also having a head portion adjacent to said front end of said shank portion engageable with said front face of said bolt to hold said bolt on said support member, said head portion having at least one planar surface parallel to said longitudinal axis;

said bolt and support member being so configured that said bolt is slidable relative to said support member along the length of said slot;

said second end of said bolt slot having a generally planar surface engageable with said planar surface of said head portion when said support member is located proximate said second end of said bolt slot to prevent rotation of said bolt relative to said support member and allow free movement of said closure member between said closed and open positions; and said bolt and support member being further configured that when said head portion is located proximate said first end of said bolt slot, said bolt is free to rotate relative to said slot about said longitudinal axis and due to its weight to assume a vertically oriented position.

3. A latch for releasably holding closed a door, drawer, window or other closure member having a vertical front surface ending at a top edge and which closure member is movable horizontally relative to an associated member located above and adjacent to the closure member, and having a vertical front face ending at a lower edge, the closure member being movable between a closed position, at which said front surface and said front face are located in substantially the same plane, and an open position at which said front surface and said front face are located in substantially different planes, said latch comprising:

a bolt;

a support member with a longitudinal axis;

said bolt being of an elongated shape with first and second longitudinal ends and front and rear faces oriented in opposite directions;

said bolt having an elongated slot defined at least in part by substantially parallel side surfaces passing through said bolt from said front face to said rear face, said slot terminating at first and second slot ends short of said first and second bolt ends, respectively;

said support member having a shank portion receivable in said bolt slot and having front and rear ends spaced apart from one another along said longitudinal axis and at least one generally planar surface parallel to said longitudinal axis;

said support member also having an attachment portion extending along said longitudinal axis from said rear end of said shank portion and which attachment portion is receivable in said associated member to attach and hold said support member to said associated member with said bolt received on said shank portion;

said support member also having a head portion adjacent to said front end of said shank portion engageable with said front face of said bolt to hold said bolt on said support member;

said bolt and support member being so configured that said bolt is slidable relative to said support member along the length of said slot;

said bolt and support member being so configured that said shank portion is engageable with said elongated slot when said support member is located proximate said second end of said slot to prevent rotation of said bolt relative to said support member and allow free movement of said closure member between said closed and open positions; and said bolt and support member being further configured that when said shank portion is located proximate said first end of said bolt slot, said bolt is free to rotate relative to said slot about said longitudinal axis and due to its weight to assume a vertically oriented position.

* * * * *

UNITED STATES PATENT AND TRADEMARK OFFICE

CERTIFICATE OF CORRECTION

PATENT NO. : 6,149,209
DATED : November 21, 2000
INVENTOR(S) : Donn Barton

It is certified that error appears in the above-identified patent and that said Letters Patent is hereby corrected as shown below:

Column 1, Line 53: After "will remain", delete "dosed" and substitute --closed--.

Column 2, Line 6: After "opened and", delete "dosed" and substitute --closed--.

Column 5, Line 9: After "returned to the", delete "dosed" and substitute --closed--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*